US007358838B2

(12) United States Patent
Gibson et al.

(10) Patent No.: US 7,358,838 B2
(45) Date of Patent: Apr. 15, 2008

(54) ELECTRICAL SWITCHING APPARATUS AND TRIP INDICATOR THEREFOR

(75) Inventors: Jeffrey S. Gibson, Hookstown, PA (US); Jeffrey W. Lockhart, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 176 days.

(21) Appl. No.: 11/361,609

(22) Filed: Feb. 24, 2006

(65) Prior Publication Data

US 2007/0200652 A1 Aug. 30, 2007

(51) Int. Cl.

| | |
|---|---|
| ***H01H 73/12*** | (2006.01) |
| ***H01H 75/00*** | (2006.01) |
| ***H01H 77/00*** | (2006.01) |
| ***H01H 83/00*** | (2006.01) |

(52) U.S. Cl. ..... 335/17

(58) Field of Classification Search ..... 335/17
See application file for complete search history.

(56) References Cited

U.S. PATENT DOCUMENTS

| | | | | |
|---|---|---|---|---|
| 3,401,363 | A | 9/1968 | Vyskocil et al. | |
| 3,443,258 | A | 5/1969 | Dunham et al. | |
| 3,596,219 | A | 7/1971 | Erickson | |
| 4,104,491 | A * | 8/1978 | Duble | 200/50.15 |
| 4,118,607 | A * | 10/1978 | Shaffer | 200/50.15 |
| 4,118,608 | A * | 10/1978 | Kussy et al. | 200/56 R |
| 4,166,989 | A * | 9/1979 | Castonguay et al. | 335/17 |
| 4,301,342 | A * | 11/1981 | Castonguay et al. | 200/400 |
| 4,598,183 | A * | 7/1986 | Gardner et al. | 200/50.03 |
| 4,801,906 | A * | 1/1989 | Morris et al. | 335/17 |
| 5,089,796 | A * | 2/1992 | Glennon et al. | 335/172 |
| 5,264,673 | A | 11/1993 | Powell | |
| 5,341,191 | A | 8/1994 | Crookston et al. | |
| 5,471,184 | A | 11/1995 | Chien et al. | |
| 5,694,101 | A | 12/1997 | Lavelle et al. | |
| 5,823,323 | A | 10/1998 | Seymour et al. | |
| 5,831,500 | A * | 11/1998 | Turner et al. | 335/17 |
| 5,847,913 | A | 12/1998 | Turner et al. | |
| 5,973,278 | A | 10/1999 | Wehrli, III et al. | |
| 5,981,887 | A | 11/1999 | Robarge et al. | |
| 6,080,947 | A | 6/2000 | Ulerich et al. | |
| 6,104,266 | A * | 8/2000 | Tilghman et al. | 335/17 |
| 6,107,902 | A | 8/2000 | Zhang et al. | |
| 6,130,390 | A | 10/2000 | Castonguay | |

(Continued)

OTHER PUBLICATIONS

U.S. Appl. No. 10/782,624, Michael J. Whipple.

*Primary Examiner*—Elvin Enad
*Assistant Examiner*—Mohamad A Musleh
(74) *Attorney, Agent, or Firm*—Martin J. Moran

(57) ABSTRACT

A trip indicator is for a circuit breaker having a housing including first and second openings, separable contacts and an operating mechanism having an operating handle protruding from the first opening. The trip indicator includes a one-piece flag member with a first end having a trip flag and a second end with first and second integral legs. The first leg biases the trip flag away from the second opening when the separable contacts are not tripped open, and includes a latching portion to maintain the flag in a viewable position to indicate the trip condition regardless of the operating mechanism position. The second leg is disposed proximate first leg and biases the operating handle toward the OFF position, thereby assisting the handle to move from the ON position in response to the trip condition.

21 Claims, 4 Drawing Sheets

U.S. PATENT DOCUMENTS 6,246,304 B1 6/2001 Gasper
6,380,501 B1 4/2002 Figueroa et al.
6,542,056 B2 4/2003 Nerstrom et al.
6,639,492 B1 10/2003 Hall et al.
6,803,535 B1 10/2004 Whipple et al.
7,135,945 B2 * 11/2006 Whipple et al. ..... 335/17

* cited by examiner

ELECTRICAL SWITCHING APPARATUS AND TRIP INDICATOR THEREFOR

BACKGROUND OF THE INVENTION

1. Field of the Invention

The present invention relates generally to electrical switching apparatus and, more particularly, to circuit breakers including a trip indicator. The invention also relates to trip indicators for circuit breakers.

2. Background Information

Circuit breakers are generally old and well known in the art. Circuit breakers are used to protect electrical circuitry from damage due to a trip condition, such as, for example, an overcurrent condition, an overload condition, an undervoltage condition, a relatively high level short circuit or fault condition, a ground fault condition or an arc fault condition.

Molded case circuit breakers, for example, include at least one pair of separable contacts which are operated either manually by way of a handle disposed on the outside of the case, or automatically by way of a trip mechanism in response to the trip condition.

Typically, a circuit breaker operating mechanism includes a cradle assembly which is operable between a latched configuration during normal circuit breaker operation, and an unlatched position in which the separable contacts are tripped open, in response to the trip condition as detected by the trip mechanism. The circuit breaker has a number of operating handle positions corresponding to the status of the separable contacts. For example, a three-position circuit breaker has three operating handle positions, an ON position corresponding to the separable contacts being closed, a second position corresponding to the circuit breaker being OFF, and a third, intermediate tripped position wherein the separable contacts are tripped open in response to the trip condition. For two-position circuit breakers on the other hand, the OFF position is also the tripped position. Specifically, when the trip condition occurs and the two-position circuit breaker trips, the operating handle is automatically forced to the OFF position, and an automatic reset mechanism automatically resets the cradle assembly after the trip condition occurs, typically while the operating handle remains in the OFF position. Therefore, the breaker is automatically ready to be turned back ON by manually pivoting the operating handle to the ON position.

In view of the shared OFF and tripped positions of this latter type of circuit breaker, there is no way to quickly visually determine the status of the circuit breaker. It is nearly impossible to determine whether the circuit breaker has tripped or has been intentionally, manually turned OFF. This is problematic in that there is no opportunity to readily identify the occurrence of a trip condition or the source of the trip condition, in order that the problem may be rectified. The problem is even more pronounced when the circuit breaker is one of a plurality of circuit breakers arranged within the same panelboard, perhaps with several breakers already being intentionally turned OFF or, for example, where the handles of several of the circuit breakers are locked in the ON position using, for example, a padlock.

To help alleviate this problem, three-position circuit breakers have been known to include a trip indicator in the circuit breaker to indicate the tripped condition. Generally, the trip indicator comprises an indicator assembly which interacts with the operating handle or cradle of the circuit breaker in order to position a visual indicia, such as a trip flag, that may include printed words indicative of the circuit breaker status (e.g., "T", "TRIPPED", "ON" or "OFF"), beneath a lens or window which covers an opening in the circuit breaker housing. The flag or other indicia is actuated, in response to the trip condition, by the cradle. For example, when the cradle unlatches in response to the trip mechanism and pivots, the separable contacts of the circuit breaker are opened and the cradle forces the flag to the indicating position. Since the position of the flag is dependent upon the position of the cradle, the flag remains visible in the indicating position until the operating handle is manually reset, thereby relatching the cradle and drawing the flag away from the indicating position.

It will be appreciated that the foregoing indicator design is not conducive for use with two-position, automatically resetting circuit breakers. More specifically, because the trip flag is dependent upon the cradle, if such a design were employed in an automatically resetting circuit breaker, the trip flag would only momentarily be visible while the cradle was in its corresponding unlatched position. The flag would then immediately be drawn away from the indicating position by the cradle as it automatically reset (i.e., relatched). Moreover, such designs do not address instances in which a trip condition occurs but the operating handle has not yet moved to the OFF or tripped position, for example, where the circuit breaker has tripped but the operating handle is padlocked in the ON position, as previously discussed. Under such circumstances, known trip flags provide no indication of the trip condition, thereby making it nearly impossible to identify which circuit breaker among a group of breakers has tripped. Thus, for two-position automatic reset circuit breakers, the problem of not being able to identify whether or not a particular circuit breaker has tripped, remains.

There is a need, therefore, for a trip indicator capable of providing an indicia of the trip condition irrespective of the position of the operating handle or cradle of the circuit breaker.

There is, therefore, room for improvement in trip indicators for circuit breakers, such as automatic reset two-position circuit breakers, and in circuit breakers employing trip indicators.

SUMMARY OF THE INVENTION

These needs and others are satisfied by the present invention, which is directed to a circuit breaker and a trip indicator therefor. The combination of resilient properties and a unique latching design of the trip indicator ensures that an indication of a trip condition will be readily apparent irrespective of the position of the circuit breaker operating mechanism, even if the operating mechanism of the breaker has automatically reset. The unique resilient and flexural qualities of the trip indicator serve the further purpose of providing a biasing force for assisting movement of the circuit breaker operating mechanism to the desired position in response to a trip condition.

As one aspect of the invention, a trip indicator is provided for an electrical switching apparatus. The electrical switching apparatus includes a housing having first and second openings, separable contacts enclosed by the housing, and an operating mechanism having an operating handle with a first end and a second end. The first end of the operating handle protrudes from the first opening of the housing. The operating mechanism is operable among OFF, ON, and tripped positions in which the separable contacts are open, closed, and tripped open, respectively, and the operating mechanism is structured to trip open the separable contacts in response to a trip condition. The trip indicator comprises:

a flag member including a trip indicia, the flag member being structured to be actuated by the operating mechanism of the electrical switching apparatus in response to the trip condition in order to move the trip indicia in order that it is viewable at or about the second opening of the housing; a first leg disposed distal from the trip indicia and being structured to bias the trip indicia away from the second opening of the housing when the separable contacts are not tripped open; and a second leg disposed proximate the first leg and being structured to bias the operating handle of the operating mechanism toward the OFF position in order to assist the operating handle to move from the ON position in response to the trip condition. In response to the trip condition, the first leg is also structured to engage a portion of the housing of the electrical switching apparatus in order to maintain a viewable trip indication by the flag member, regardless of the position of the operating mechanism of said electrical switching apparatus.

The flag member may be a one-piece member wherein the first and second legs are integral portions of the one-piece flag member. The flag member, the first leg, and the second leg may be made of a resilient material. The trip indicia may be a trip flag which is structured to be readily apparent at the second opening of the housing following the trip condition.

The operating mechanism may further include a cradle pivotally mounted within the housing proximate the second end of the operating handle and movable between a latched position, and an unlatched position in which the separable contacts are tripped open. The flag member may be structured to be engaged by the cradle when the cradle is in the unlatched position, in order to move the trip indicia toward the second opening of the housing of the electrical switching apparatus.

As another aspect of the invention, an electrical switching apparatus comprises: a housing including first and second openings; separable contacts enclosed within the housing; an operating mechanism including an operating handle for opening and closing the separable contacts, the operating handle including a first end protruding from the first opening of the housing, and a second end, the operating mechanism being movable among OFF, ON and tripped positions corresponding to the separable contacts being open, closed and tripped open, respectively; and a trip flag comprising: a flag member including a first end and a second end, the first end of the flag member having a trip indicia, the second end of the flag member having a first leg and a second leg, the first leg biasing the trip indicia away from the second opening of the housing when the separable contacts are not tripped open, the second leg biasing the operating handle toward the OFF position in order to assist the operating handle to move from the ON position in response to the trip condition, wherein when the separable contacts trip open in response to a trip condition, the flag member is engaged by the operating mechanism in order to move the trip indicia into a viewable position at or about the second opening of the housing. In response to the trip condition, the first leg engages a portion of the electrical switching apparatus housing in order to maintain a viewable trip indication by the trip flag, regardless of the position of said operating mechanism.

The housing of the electrical switching apparatus may include a latching boss and the first leg of the flag member may include a latching portion, wherein when the separable contacts are tripped open, the latching portion of the first leg is engaged with the latching boss of the housing in order to maintain the viewable position of the trip indicia at the second opening of the housing.

As another aspect of the invention, a circuit breaker comprises: a housing including first and second openings; separable contacts enclosed within the housing; an operating mechanism including a cradle and an operating handle for opening and closing the separable contacts, the operating handle including a first end protruding from the first opening of the housing, and a second end, the operating mechanism moving among OFF, ON and tripped positions corresponding to the separable contacts being open, closed and tripped open, respectively, the cradle being pivotally mounted within the housing proximate the second end of the operating handle and movable between a latched position, and an unlatched position corresponding to the separable contacts being tripped open in response to a trip condition; and a trip indicator comprising: a trip indicating member including a first end and a second end, the first end of the trip indicating member having a trip indicia, the second end of the trip indicating member including a first portion and a second portion, the first portion biasing the trip indicia away from the second opening of the housing when the separable contacts are not tripped open, the second portion biasing the operating handle of the operating mechanism toward the OFF position in order to assist the operating handle to move from the ON position in response to the trip condition, wherein the cradle in the unlatched position is engaged with the trip indicating member in order to move the trip indicia into a position which is viewable at or about the second opening of the housing. In response to the trip condition, the cradle drives the trip indicating member toward the circuit breaker housing until the first leg engages a portion of the housing in order to maintain a viewable trip indication by the trip indicating member, regardless of the position of said cradle. When the first leg engages the housing, the trip indicating member is disengaged from the cradle.

The trip indicating member may be a flag member wherein the first portion of the flag member is a first leg disposed distal from the trip indicia, and the second portion is a second leg disposed proximate the first leg. The flag member may be a one-piece flag member wherein the first and second legs are integral legs of the one-piece flag member. The one-piece flag member may be made of a resilient plastic material.

The cradle may include an engagement portion and the trip indicating member may further include a pivot disposed generally intermediate the first and second ends thereof, wherein when the cradle is in the unlatched position and the separable contacts are tripped open, the engagement portion is engaged with the trip indicating member in order to pivot the trip indicating member about the pivot and to move the trip indicia toward the second opening of the housing of the electrical switching apparatus. The trip indicating member may include a protrusion protruding toward the cradle and being engaged by the cradle in order to facilitate actuation of the trip indicating member in response to the trip condition.

The circuit breaker housing may include a latching boss and the first portion of the second end of the trip indicating member may be an integral first leg which includes a latching portion. When the separable contacts are tripped open, the latching portion of the integral first leg may be engaged with the latching boss of the housing in order to maintain the position of the trip indicia at or about the second opening of the housing. The second end of the operating handle may include a reset tab wherein, when the handle is moved in order to turn the circuit breaker ON, the reset tab of the operating handle engages the latching portion of the first leg and removes it from the latching boss, thereby removing the trip indicia from the second opening.

The circuit breaker may be a two-position circuit breaker wherein the OFF position of the operating handle is the same as the tripped position of the handle. The operating mechanism may be an automatic reset mechanism wherein, in response to the trip condition, the automatic reset mechanism automatically resets (i.e., relatches) the cradle while the trip indicator remains viewable at or about the second opening of the circuit breaker housing.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the invention will be described as applied to the trip indicator of a two-position automatic reset circuit breaker, although it will become apparent that it could also be applied to other types of electrical switching apparatus (e.g., without limitation, circuit switching devices and other circuit interrupters, such as, for example, contactors, motor starters, motor controllers and other load controllers) having an operating mechanism with a tripped position.

As employed herein, the term "trip condition" refers to any abnormal electrical condition which could cause a circuit breaker to trip expressly including, without limitation, an overcurrent condition, an overload condition, an undervoltage condition, a relatively high level short circuit or fault condition, a ground fault condition or an arc fault condition.

As employed herein, the term "trip indicia" refers to any suitable visual indication of a trip condition, expressly including but not limited to a colored indicator, a light emitting diode (LED), a trip flag, a suitable word (e.g., "TRIPPED") or a suitable letter (e.g., "T") or other suitable term(s) or indicia, including a member protruding from an opening in the circuit breaker housing in order to indicate the trip condition. Indicia such as, for example, the words "ON" and "OFF" or positive (+) and negative (−) signs, which indicate non-tripped status of the breaker, are also contemplated by the invention.

As employed herein, the term "resilient" refers to the flexible nature of the exemplary flag member which is facilitated in large part by the material from which it is made. Specifically, the material (e.g., without limitation, plastic) can be temporarily flexed or deflected from a natural position in which no external force is acting upon it, to a deflected position in which it is deflected or displaced from its natural position in response to being engaged and moved by an external force. Upon removing the external force, it will return to the natural position. In this manner, the resilient flag member of the invention provides the desired biasing forces, as will be discussed in detail herein.

Figure 1:
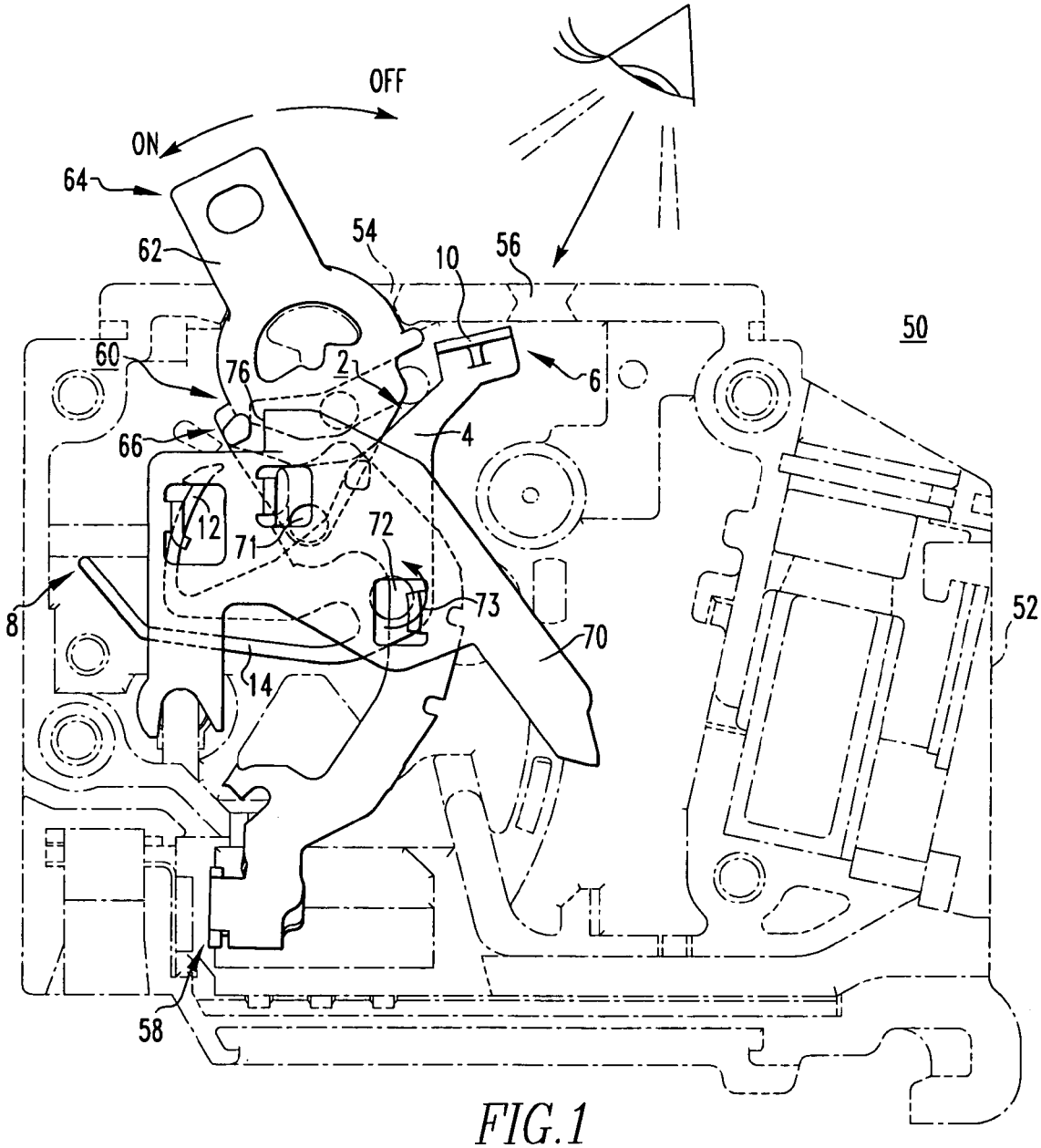
FIG. 1 is a cross-sectional vertical elevational view of a two-position automatic reset molded case circuit breaker having a trip indicator in accordance with the present invention and shown in the ON position.

FIG. 1 illustrates a circuit breaker 50 incorporating a trip indicator 2 in accordance with the present invention. In this example, the circuit breaker 50 is a single-pole circuit breaker including a molded housing 52 having first and second openings 54,56, separable contacts 58 enclosed within the housing 52, and an operating mechanism 60 having an operating handle 62 with first and second ends 64,66. The operating mechanism 60 is structured to trip open the separable contacts 58 in response to a trip condition. The first end 64 of the operating handle 62 protrudes from the first opening 54 of the housing 52 and is structured to open and close the separable contacts 58.

Figure 2:
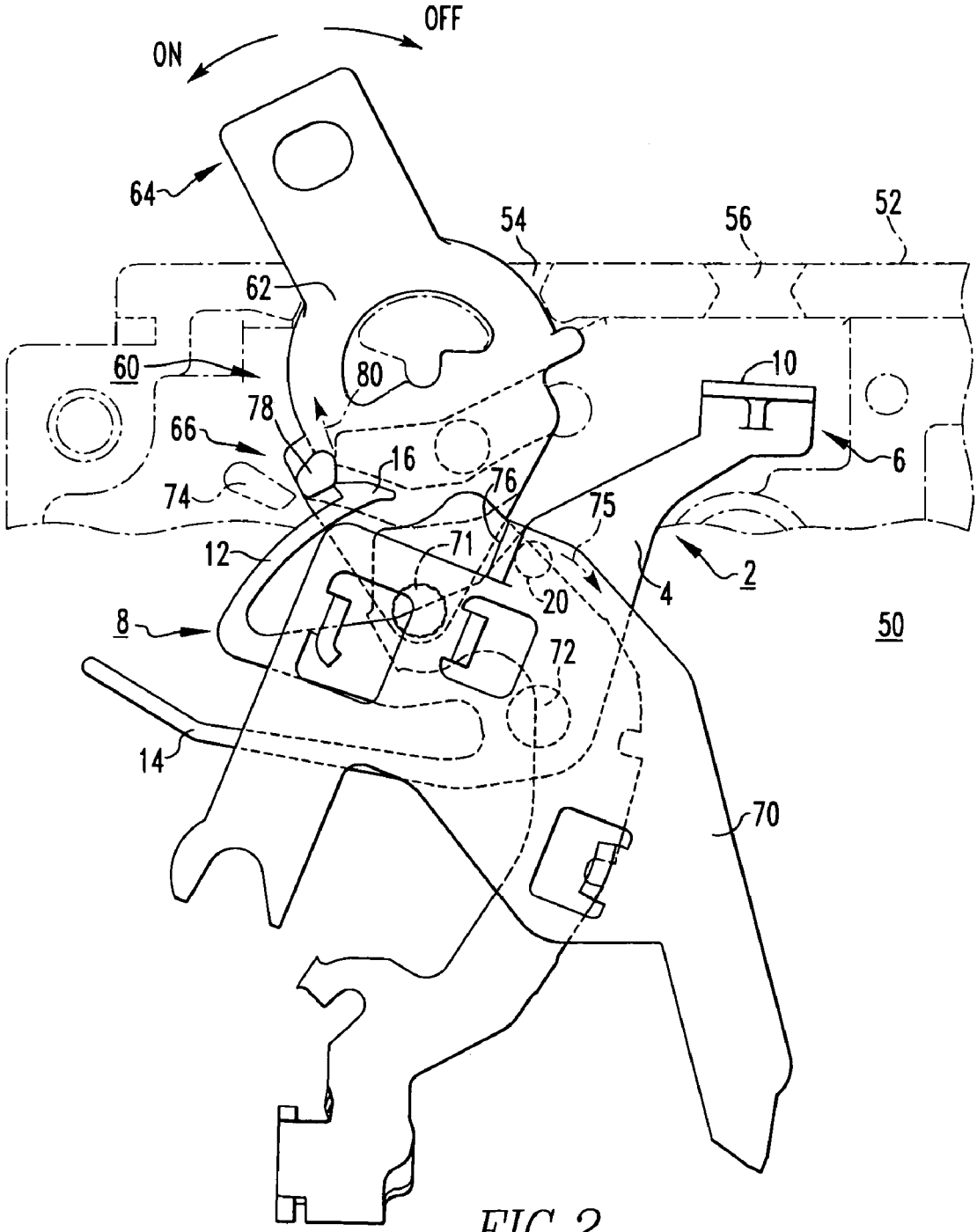
FIG. 2 is a cross-sectional vertical elevational view of a portion of the circuit breaker of FIG. 1 modified to show the cradle and trip indicator in the tripped position with the handle in the ON position, with the majority of the circuit breaker shown in phantom line drawing.

FIG. 1 shows the circuit breaker 50 in the ON position with the trip indicator 2 pivoted away from the second opening 56 of housing 52 and the operating handle 62 disposed in the operating position corresponding to the separable contacts 58 being closed. The operating mechanism 60 moves among OFF, ON and tripped positions corresponding to the separable contacts 58 being open, closed and tripped open, respectively. FIG. 2, however, illustrates the aforementioned occurrence in which the operating handle 62 remains in the ON position even though the circuit breaker 50 has tripped. In the exemplary single-pole circuit breaker 50, the operating handle positions for the manually turned OFF (FIG. 3) and tripped (FIG. 2) conditions are normally essentially the same, with the operating handle 62 positioned at an end of first opening 54 of housing 52 (e.g., to the right of FIG. 2), in both instances. As will be discussed herein, unlike known indicators which are dependant on the position of the operating mechanism cradle or operating handle, and/or rely upon the handle remaining in the tripped position in order to maintain the trip indication, the trip indicator 2 of the invention is structured to present a trip indicia 10 identifying the occurrence of a trip condition, regardless of the position of the handle 62. It will be appreciated, however, that the operating handle (e.g., 62) could alternatively have any known or suitable number and configuration of operating handle positions. For example, it could have three operating positions (not shown), including a separate tripped position (not shown) between the ON and OFF positions. It will also be appreciated that the circuit breaker could alternatively be a multi-pole circuit breaker (not shown) having any number of poles (not shown) with any suitable number of operating handles (not shown) and employing one or more trip indicators, such as trip indicator 2.

As shown in FIGS. 1, 2, 3 and 4, the trip indicator 2 includes a trip indicating member 4 having a first end 6 and a second end 8. The first end 6 includes a trip indicia 10 such as the exemplary trip flag which, as shown in FIGS. 1, 2, 3 and 4, is viewable at or about the second opening 56 of housing 52 in order to provide a readily apparent visual indication of a trip condition. In the example shown and described herein, the trip indicating member 4 is a one-piece flag member including the trip flag 10 at first end 6, and integral first and second legs 12, 14 disposed distal from the trip flag 10, at second end 8. FIGS. 1, 2, 3 and 4 provide cross-sectional views of the single-pole circuit breaker 50 illustrating the trip indicator 2 as employed when the circuit breaker 50 is ON, tripped with the operating handle 62 locked in the ON position, OFF after a trip condition, and being turned back ON, respectively.

The operating mechanism 60 of single-pole circuit breaker 50 further includes a cradle 70 pivotally mounted within the housing 52 proximate the second end 66 of the operating handle 62. The pivotal connection of the cradle 70 to the housing 52 is achieved by any known or suitable mechanism, such as a pivot pin 71. The cradle 70 is moveable between the latched position shown in FIGS. 1, 3, and 4, and the unlatched position of FIG. 2 corresponding to the separable contacts 58 (FIG. 1) being tripped open. When the circuit breaker 50 is not tripped and the cradle 70 is latched, as shown in FIG. 1, the cradle 70 does not engage the flag member 4 and, therefore, the second leg 14 of the second end 8 of the flag member 4 engages housing 52, as shown, in order to bias the flag member 4 pivoting it counterclockwise about pivot pin 72 in the direction generally indicated by arrow 73. More specifically, the integral, resilient second leg 14, which is made of a resilient material (e.g., without limitation, plastic), biases the trip indicator 2 such that the trip flag 10 on the first end 6 of the trip indicating member 4 pivots counterclockwise away from the second opening 56 of housing 52. Such bias is, therefore, applied without requiring a separate resilient element, such as for example, a separate torsion spring. Accordingly, when the cradle 70 is fully latched (e.g., the circuit breaker 50 is not tripped), the trip flag 10 is moved out of view from the second opening 56 of housing 52 thus signifying a normal (e.g., non-tripped) circuit breaker operating status.

Figure 4:
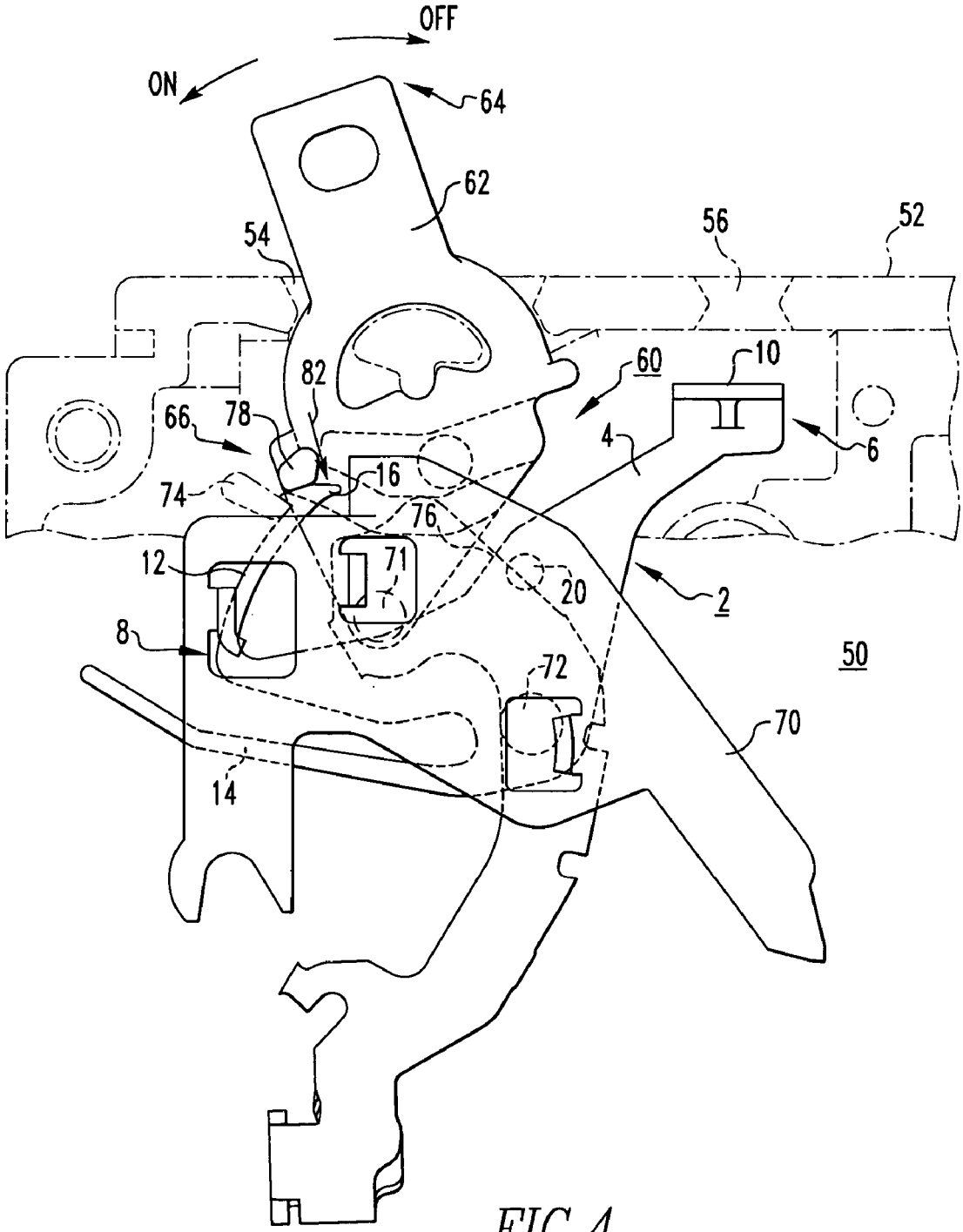
FIG. 4 is a cross-sectional vertical elevational view showing the circuit breaker and trip flag of FIG. 1 as the operating handle is being moved back to the ON position in order to release the trip indicator.

Conversely, referring to FIGS. 2 and 4, when the circuit breaker 50 trips, the separable contacts 58 (FIG. 1) trip open and the cradle 70 unlatches and pivots clockwise, as indicated by arrow 75 of FIG. 2. In doing so, an engagement portion 76 of the cradle 70 engages a portion 20 of the flag member 4 pivoting the flag member 4 clockwise (see, arrow 75 of FIG. 2) about pivot 72 in order to position the trip flag 10 at or about the second opening 56 of housing 52, as shown. The pivot 72 is disposed generally intermediate the first and second ends 6, 8 of the flag member 4 in order to permit clockwise and counterclockwise movement thereof. The portion 20 of flag member 4 is a protrusion 20 which protrudes toward the cradle 70 in order to be engaged by engagement portion 76 and thereby facilitate actuation of the trip indicating member 2 in response to the trip condition.

Figure 3:
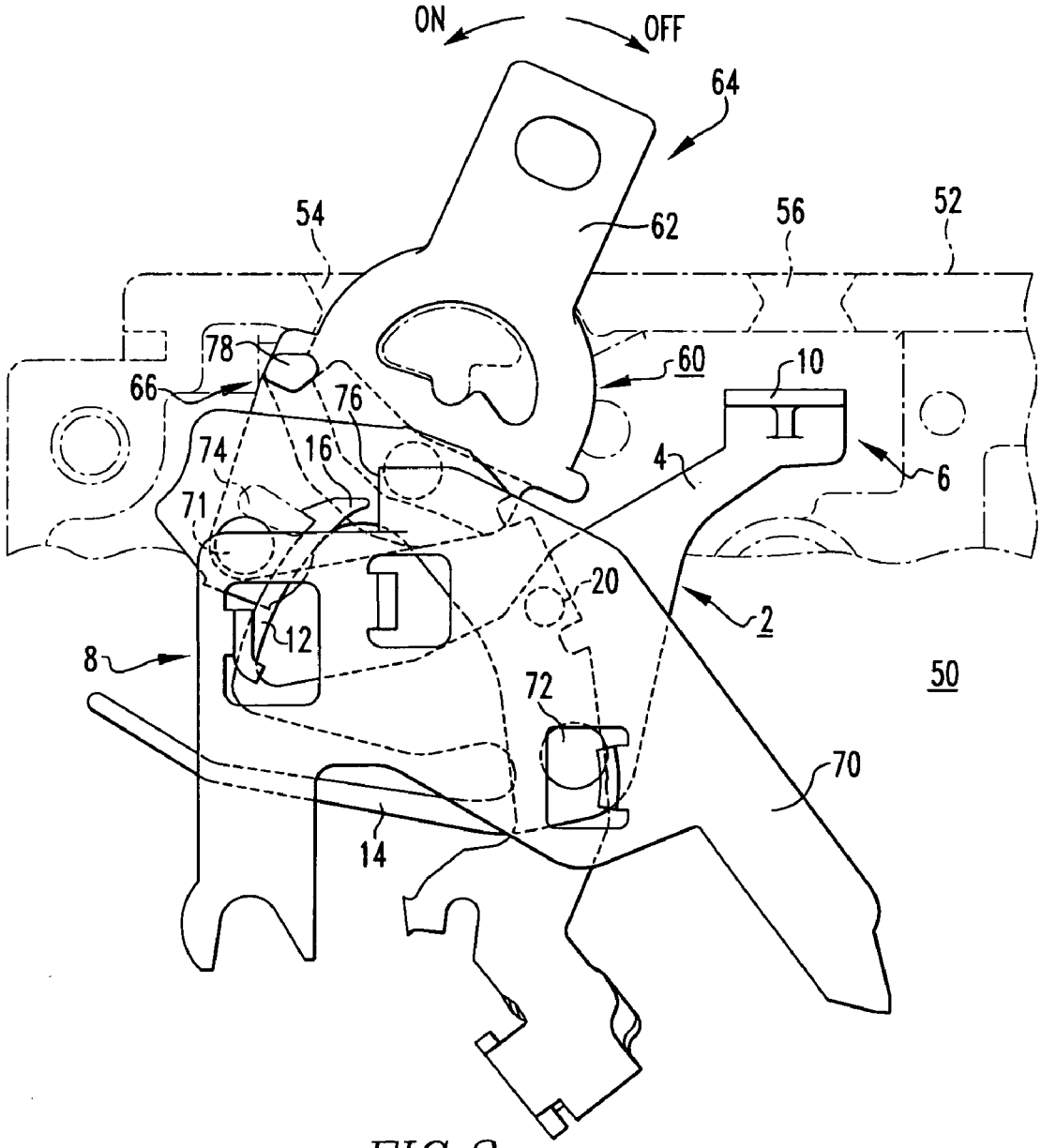
FIG. 3 is a cross-sectional vertical elevational view of the circuit breaker and trip flag of FIG. 1 but modified to show the operating handle in the OFF position after a trip condition, with the majority of the circuit breaker shown in phantom line drawing.

In addition to the visual indication provided by the exemplary trip indicator 2, which assures a correct indication of the trip condition even if the operating handle 62 were locked (not shown), for example, in the ON position, as shown in FIG. 2. The present invention further provides a biasing feature adapted to assist the operating handle 62 to move from the ON position toward the tripped position, in response to the tripped condition. Specifically, as best shown in FIGS. 2, 3 and 4, the circuit breaker housing 52 includes a latching boss 74, the first leg 12 of the second end 8 of the flag member 4 includes a latching portion 16, and the second end 66 of the circuit breaker operating handle 62 includes a reset tab 78. Similar to first leg 12, the second leg 14 is also integral with flag member 4 and is made from a resilient material (e.g., without limitation, plastic). Accordingly, as shown in FIG. 2, the second leg 14 and, in particular, the latching portion 16 thereof, is structured to bias the second end 66 (e.g., at reset tab 78) of the operating handle 62 in the direction indicated by arrow 80. In this manner, the trip indicator 2 of the invention serves the additional purpose of biasing the operating handle 62 toward the OFF position in order to resist the operating handle 62 from becoming stuck in the ON position.

As shown in FIG. 3, in operation, when the cradle 70 is returned to the latched position after a trip condition, handle 62 is in the OFF position, the latching portion 16 of first leg 12 engages latching boss 74 of housing 52 and remains visible at second opening 56, thereby providing a readily apparent indication for distinguishing a breaker which has experienced a trip condition from those which have been manually turned OFF. When handle 62 is rotated counterclockwise (with respect to FIG. 4) to turn ON the circuit breaker 50, the reset tab 78 engages the latching portion 16 of first leg 12 removing it from the latching boss 74, as indicated by arrow 82 of FIG. 4. Accordingly, when the latching portion 16 of first leg 12 of the exemplary one-piece flag member 4 is in engagement with latching boss 74 of the circuit breaker housing 52, the bias provided by the first leg 12 resists movement of the trip flag 10 from at or about the second opening 56 of the housing 52 and, therefore, substantially prevents the possibility of the trip indication being removed prematurely (e.g., while the cradle 70 remains unlatched and the separable contacts (FIG. 1) are still tripped open). More specifically, the trip flag 10 will remain in the trip indicating position of FIGS. 3 and 4 until both the cradle 70 has been relatched and the operating handle 62 has been reset to the ON position of FIG. 1 with the latching portion 16 of first leg 12 being removed from latching boss 74. Only when the foregoing two conditions have been met will second leg 14 of flag member 4 be able to pivot the flag member 4 about pivot pin 72 in order to rotate the trip flag 10 out of view at the second opening 56 of the circuit breaker housing 52, as shown in FIG. 1.

Accordingly, the present invention provides a trip indicator 2 which not only provides an accurate visual indication of a trip condition, which is substantially independent of the position of the circuit breaker operating mechanism cradle and operating handle, but it also provides a biasing mechanism to assist the operating handle 62 in, for example, moving from the ON position in response to a trip condition. The unique resilient properties of the trip indicator 2 enable it to perform this dual function through use of a one-piece indicating member 4.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A trip indicator for an electrical switching apparatus including a housing having first and second openings, separable contacts enclosed by said housing, and an operating mechanism having an operating handle with a first end and a second end, the first end of the operating handle protruding from the first opening of said housing, said operating mechanism being operable among OFF, ON, and tripped positions in which said separable contacts are open, closed, and tripped open, respectively, and being structured to trip open said separable contacts in response to a trip condition, said trip indicator comprising:

a flag member including a trip indicia, said flag member being structured to be actuated by said operating mechanism of said electrical switching apparatus in response to said trip condition in order to move said trip indicia in order that it is viewable at or about the second opening of said housing;

a first resilient leg disposed distal from said trip indicia and being structured to bias said trip indicia away from the second opening of said housing when said separable contacts are not tripped open; and a second resilient leg disposed proximate said first leg and being structured to bias said operating handle of said operating mechanism toward the OFF position in order to assist said operating handle to move from the ON position in response to said trip condition, wherein, in response to said trip condition, said first resilient leg is structured to engage a portion of said housing of said electrical switching apparatus in order to maintain a visual trip indication by said flag member, regardless of the position of said operating mechanism of said electrical switching apparatus, and wherein said first resilient leg is structured to bias said trip indicia and said second resilient leg is structured to bias said operating handle, without a number of separate springs.

2. The trip indicator of claim 1 wherein said flag member is a one-piece flag member; and wherein said first and second resilient legs are integral portions of said one-piece flag member.

3. The trip indicator of claim 1 wherein said flag member, said first resilient leg, and said second resilient leg are made of a resilient material.

4. The trip indicator of claim 1 wherein said trip indicia is a trip flag which is structured to be readily apparent at the second opening of said housing following said trip condition.

5. The trip indicator of claim 1 wherein said operating mechanism further has a cradle pivotally mounted within said housing proximate the second end of said operating handle, said cradle being movable between a latched position, and an unlatched position in which said separable contacts are tripped open; and wherein said flag member is structured to be engaged by said cradle when said cradle is in the unlatched position, in order to move said trip indicia toward the second opening of said housing of said electrical switching apparatus.

6. An electrical switching apparatus comprising:

a housing including first and second openings;

separable contacts enclosed within said housing;

an operating mechanism structured to trip open said separable contacts in response to a trip condition, and including an operating handle for opening and closing said separable contacts, said operating handle including a first end protruding from the first opening of said housing, and a second end, said operating mechanism being movable among OFF, ON and tripped positions corresponding to said separable contacts being open, closed and tripped open, respectively; and a trip flag comprising:

a flag member including a first end and a second end, the first end of said flag member having a trip indicia, the second end of said flag member having a first resilient leg and a second resilient leg, said first resilient leg biasing said trip indicia away from the second opening of said housing when said separable contacts are not tripped open, said second resilient leg biasing said operating handle toward the OFF position in order to assist said operating handle to move from the ON position in response to said trip condition, wherein when said separable contacts trip open in response to said trip condition, said flag member is engaged by said operating mechanism in order to move said trip indicia into a viewable position at or about the second opening of said housing, wherein, in response to said trip condition, said first resilient leg engages a portion of said housing of said electrical switching apparatus in order to maintain a visual trip indication by said flag member, regardless of the position of said operating mechanism of said electrical switching apparatus, and wherein said first resilient leg biases said trip indicia and said second resilient leg biases said operating handle, without a number of separate springs.

7. The electrical switching apparatus of claim 6 wherein said flag member is a one-piece flag member; and wherein said first and second resilient legs are integral portions of said one-piece flag member.

8. The electrical switching apparatus of claim 6 wherein said flag member is made of a resilient material.

9. The electrical switching apparatus of claim 6 wherein said operating mechanism further includes a cradle pivotally mounted within said housing proximate the second end of said operating handle, said cradle being movable between a latched position, and an unlatched position in which said separable contacts are tripped open; and wherein said flag member is engaged by said cradle when said cradle is in the unlatched position, in order to move said trip indicia toward the second opening of said housing of said electrical switching apparatus.

10. The electrical switching apparatus of claim 6 wherein said housing includes a latching boss; wherein said first leg of said flag member includes a latching portion; and wherein when said separable contacts are tripped open, said latching portion of said first resilient leg is engaged with said latching boss of said housing in order to maintain the viewable position of said trip indicia at the second opening of said housing.

11. A circuit breaker comprising:

a housing including first and second openings;

separable contacts enclosed within said housing;

an operating mechanism including a cradle and an operating handle for opening and closing said separable contacts, said operating handle including a first end protruding from the first opening of said housing, and a second end, said operating mechanism moving among OFF, ON and tripped positions corresponding to said separable contacts being open, closed and tripped open, respectively, said cradle being pivotally mounted within said housing proximate the second end of said operating handle and movable between a latched position, and an unlatched position corresponding to said separable contacts being tripped open in response to a trip condition; and a trip indicator comprising:

a trip indicating member including a first end and a second end, the first end of said trip indicating member having a trip indicia, the second end of said trip indicating member including a first resilient portion and a second resilient portion, said first resilient portion biasing said trip indicia away from the second opening of said housing when said separable contacts are not tripped open, said second resilient portion biasing said operating handle of said operating mechanism toward the OFF position in order to assist said operating handle to move from the ON position in response to said trip condition, wherein said cradle in said unlatched position is engaged with said trip indicating member in order to move said trip indicia into a position which is viewable at or about the second opening of said housing, wherein, in response to said trip condition, said cradle drives said first resilient portion toward said circuit breaker housing until said first resilient portion engages a portion of said housing, in order to maintain a visual trip indication by said trip indicating member, regardless of the position of said cradle and said operating handle, wherein, when said first resilient portion engages said housing, said trip indicating member is disengaged from said cradle, and wherein said first resilient portion biases said trip indicia and said second resilient portion biases said operating handle, without a number of separate springs.

12. The circuit breaker of claim 11 wherein said trip indicating member is a flag member; wherein said first resilient portion of said flag member is a first resilient leg disposed distal from said trip indicia; and wherein said second resilient portion is a second resilient leg disposed proximate said first resilient leg.

13. The circuit breaker of claim 12 wherein said flag member is a one-piece flag member; and wherein said first and second resilient legs are integral legs of said one-piece flag member.

14. The circuit breaker of claim 13 wherein said one-piece flag member is made of a resilient plastic material.

15. The circuit breaker of claim 11 wherein said cradle includes an engagement portion; wherein said trip indicating member further includes a pivot disposed generally intermediate the first and second ends thereof; and wherein when said cradle is in said unlatched position and said separable contacts are tripped open, said engagement portion is engaged with said trip indicating member in order to pivot said trip indicating member about said pivot and to move said trip indicia toward the second opening of said housing of said circuit breaker.

16. The circuit breaker of claim 15 wherein said trip indicating member includes a protrusion protruding toward said cradle and being engaged by said cradle in order to facilitate actuation of said trip indicating member in response to said trip condition.

17. The circuit breaker of claim 11 wherein said housing includes a latching boss; wherein said first resilient portion of the second end of said trip indicating member is an integral first leg which includes a latching portion; and wherein when said separable contacts are tripped open, said latching portion of said integral first leg is engaged with said latching boss of said housing in order to maintain the position of said trip indicia at or about the second opening of said housing.

18. The circuit breaker of claim 17 wherein the second end of said operating handle includes a reset tab; and wherein when said operating handle is moved in order to turn said circuit breaker ON, said reset tab of said operating handle engages said latching portion of said first leg and removes it from said latching boss.

19. The circuit breaker of claim 18 wherein said cradle includes a pivot; and wherein when said circuit breaker is ON and said latching portion of said first leg disengages said latching boss, said trip indicating member pivots with respect to said pivot in order to move said trip indicia away from the second opening of said housing.

20. The circuit breaker of claim 11 wherein said trip indicia is a trip flag which is readily apparent at or about the second opening of said housing following said trip condition.

21. The circuit breaker of claim 11 wherein said circuit breaker is a two-position circuit breaker; wherein the OFF position of said operating handle of said two-position circuit breaker is the same as the tripped position of said operating handle; wherein said operating mechanism is an automatic reset mechanism; and wherein, in response to said trip condition, said automatic reset mechanism automatically resets said cradle after it unlatches and trips open said separable contacts, while said trip indicating member remains viewable at or about the second opening of said housing.

* * * * *